United States Patent [19]

Kavoussi et al.

[11] Patent Number: 4,679,943

[45] Date of Patent: Jul. 14, 1987

[54] SCENT CLOCK BIMETALLIC DEVICE

[76] Inventors: James P. Kavoussi, 1401 80th St., Brooklyn, N.Y. 11228; Louise D. Hartford, 391 Durant Ave., Staten Island, N.Y. 10308

[21] Appl. No.: 928,242

[22] Filed: Nov. 7, 1986

[51] Int. Cl.[4] ..... G04B 47/00; B67D 5/08

[52] U.S. Cl. ..... 368/12; 222/644; 219/275

[58] Field of Search ..... 368/10, 12, 72–75, 368/243, 250; 222/70, 638, 642–648; 219/272–275

[56] References Cited

U.S. PATENT DOCUMENTS 3,455,102 7/1969 Wolf ..... 368/73

3,786,628 1/1974 Fossard et al. ..... 368/250

4,068,780 1/1978 Fegley ..... 222/649

4,407,585 10/1983 Hartford et al. ..... 368/12

4,631,387 12/1986 Glucksman ..... 219/274

*Primary Examiner*—Vit W. Miska

*Attorney, Agent, or Firm*—Richard L. Miller

[57] ABSTRACT

A scent clock bimetallic device for releasing odors into the environment for exposing heat sensitive fragrance releasing material has a heating element and a shutter vane rotatively secured to a thermal mass and mechanically linked to a bimetallic strip whereby the shutter vane is caused to rotate in response to heat and exposed said heat sensitive fragrance releasing material to the environment.

4 Claims, 3 Drawing Figures

SCENT CLOCK BIMETALLIC DEVICE

BACKGROUND OF THE INVENTION

The instant invention relates generally to scent-awake clocks and more specifically to device which will implement the distribution of such scents.

Numerous scent-awake clocks have been provided in the prior art that are adapted to provide the distribution of various scents. For example, U.S. patents to applicants Kavoussi & Hartford, Nos. 4,573,804, and 4,407,585 both are illustrative of such prior art. While these units may be suitable for the particular purpose to which they address, they would not be as suitable or for the same purpose of the present invention as hereafter described.

SUMMARY OF THE INVENTION

A primary object of the present invention is to provide a scent clock bimetallic device that will overcome the shortcomings of the prior art devices.

Another object is to provide scent clock bimetallic device that is virtually noiseless in its operation.

An additional object is to provide scent clock bimetallic device which may act as a cooperative peripheral component when joined with other existing state of the art devices.

A further object is to provide scent clock bimetallic device that is simple and easy to use.

A still further object is to provide scent clock bimetallic device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
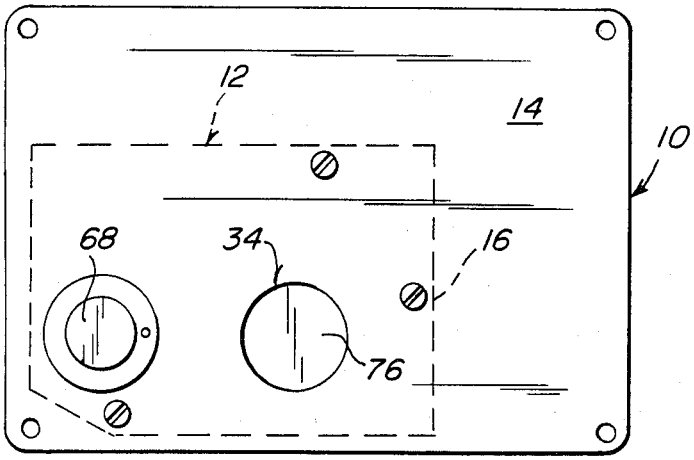
FIG. 1 is a top plan view of the instant invention.
Figure 2:
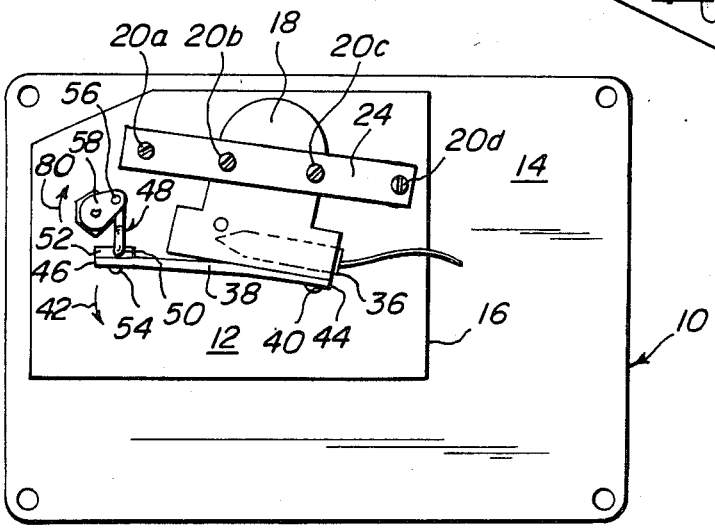
FIG. 2 is a bottom plan view of the instant invention.

Turning now descriptively to the drawings, in which like reference characters denote like elements throughout the several views, FIGS. 1 and 2 shows top and bottom views respectively of outline 16 in phantom and solid respectively of an insulated housing block 12 of the instant invention 10 along with a combination cover and mounting plate 14.

Figure 3:
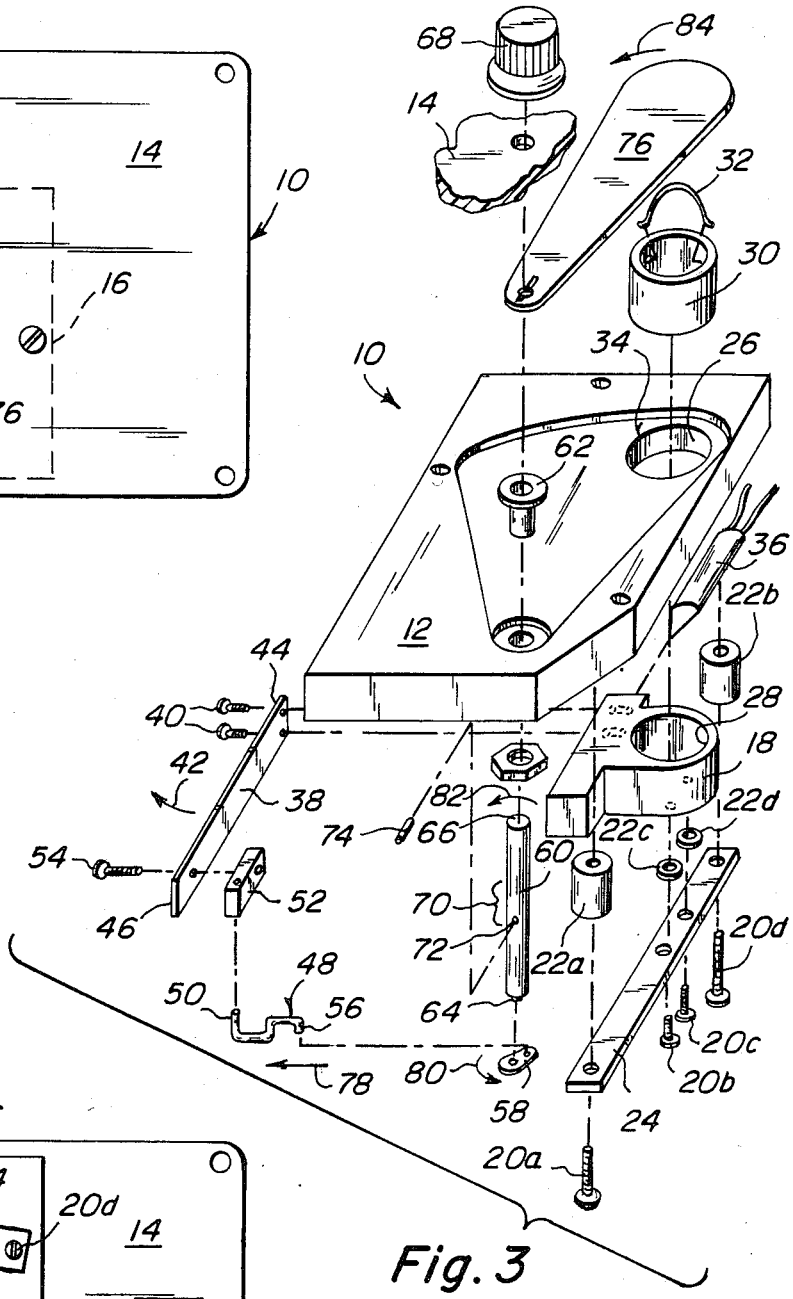
FIG. 3 is an exploded perspective view of the various internal parts which form the mechanism of the instant invention.

As may be better visulaized by referring to the exploded perspective in FIG. 3, with most of the combination cover and mounting plate 14 broken away, the insulated housing block 12 which is fabricated out of a heat resistant material typically such as bakelite and has mounted below it a heat distribution mass 18 which is fabricated out of a material which is an excellent conductor of heat typically such as copper. The heat distribution mass 18 is securely held to the insulated housing block 12 by an assortment of various conventional mounting hardward which includes four screws 20*a*, 20*b*, 20*c*, and 20*d*, four spacers 22*a*, 22*b*, and 22*d*, and an insulating mounting strip 24.

Two coaxial circular holes 26 and 28 respectively in the insulated housing block 12 and the heat distribution mass 18 are held in alignment so as to form a well 34 which can receive a small fragrance holder pail 30, which has a bail handle 32 to facilitate easy removal and insertion of the bail into the well 34.

The heat distribution mass 18 has embedded in a cavity in heating element 36, and a bimetallic strip 38 at one end 44 is secured to the heat distribution mass 18 in close proximity to the heating element 36 with two small screws 40. The bimetallic strip 38 is laminated in such a manner that when heated above room ambient by the heating element 36 the bimetallic strip 38 is caused to bend in the direction indicated by arrow 42 from an other wise relatively straight position. Rotatively connected with appropriate hardware, bearing block 52 and screw 54 to the opposite end 46 of the bimetallic strip 38 is one end 50 of an S-shaped link 48.

The opposite end 56 of S-shaped link 48, is pivotally connected to a crank arm 58 which in turn is rigidly affixed at one end 64 of a shaft 60, which rotatively mounted in a bushing 62 which in turn passes through the insulated housing block 12. The opposite end 66 of shaft 60, after passing through the combination cover and mounting plate 14, has a serrated knob 68 rigidly secured thereto, while the center portion 70 is provisioned with a small hole 72, so as to receive a small key pin 74. The key pin 74 serves the purpose of rotatively affixing shutter van 76 to shaft 60 so that the two parts that is shaft 60 and shutter vane 76 rotate as a single unit.

In operative use when the heating element 36 is energized two simultaneous actions occur as the temperature slowly rise from a room ambient to some desired operating temperature. The rise in temperature causes incense or what ever other heat sensitive fragrance releasing material that has been placed into small fragrance holder pail 30, to release odors into the environment, while at the same time bimetallic strip 38 is caused to bend from a relaxed straight position in the direction illustrated by arrow 42, and in turn move all of the linkage connected therewith in the direction of associated arrows 78, 80, 82, and 84 so as to further expose the fragrance releasing material in the holder pail 30 to the environment.

The serrated knob 68 permits the user to over come any bias force causes by bimettalic strip 38 and rotate the shutter vane 76 out of the way as may be so desired when replacing the heat sensitive fragrance releasing material to be placed into small fragrance holder pail 30. The entire mechanism achieves the result of releasing the fragrance without making any detectable sound what so ever.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A scent clock bimetallic device for releasing odors into the environment comprising:

a. a mass having a cavity for placing a heat sensitive fragrance releasing material, and means for exposing said cavity;

b. a heating means for heating said heat sensitive fragrance releasing material and;

c. a bimetallic strip responsive to said heat caused by said heating means for operating said exposing means for exposing said heat sensitive fragrance releasing material directly to the environment.

2. A scent clock bimetallic device as recited in claim 1, wherein said cavity has a well provisioned to receive a removable holder pail for easily replacing said heat sensitive fragrance releasing material.

3. A scent clock bimetallic device as recited in claim 2, wherein said heating means comprises an electrical heating element embeded into a said mass in close proximity to said well.

4. A scent clock bimetallic device as recited in claim 3, wherein said means for exposing said cavity containing said heat sensitive fragrance releasing material is a shutter vane rotatively secured to said mass and mechanically linked to said bimetallic strip whereby said shutter vane is caused to rotate in response to said heat and exposed said heat sensitive fragrance releasing material to the environment.

* * * * *